US010946395B2

(12) United States Patent
Medeiros

(10) Patent No.: US 10,946,395 B2
(45) Date of Patent: Mar. 16, 2021

(54) SHOWER HEAD

(71) Applicant: Kevin J. Medeiros, Marstons Mills, MA (US)

(72) Inventor: Kevin J. Medeiros, Marstons Mills, MA (US)

( * ) Notice: Subject to any disclaimer, the term of this patent is extended or adjusted under 35 U.S.C. 154(b) by 208 days.

(21) Appl. No.: 16/268,920

(22) Filed: Feb. 6, 2019

(65) Prior Publication Data

US 2020/0246811 A1 Aug. 6, 2020

(51) Int. Cl.

| | |
|---|---|
| ***B05B 1/18*** | (2006.01) |
| ***B05B 1/08*** | (2006.01) |
| ***B05B 3/06*** | (2006.01) |
| ***A47K 3/28*** | (2006.01) |
| ***E03C 1/06*** | (2006.01) |
| *B05B 3/08* | (2006.01) |

(52) U.S. Cl.

CPC ..... *B05B 1/185* (2013.01); *A47K 3/28* (2013.01); *E03C 1/06* (2013.01); *B05B 3/06* (2013.01); *B05B 3/082* (2013.01)

(58) Field of Classification Search

CPC .. A47K 3/28; B05B 1/18; B05B 1/185; B05B 3/06; B05B 3/082

USPC ..... 239/558

See application file for complete search history.

(56) References Cited

U.S. PATENT DOCUMENTS 6,775,865 B1 * 8/2004 Lin ..... B05B 1/18 4/615
9,114,414 B2 * 8/2015 Stein ..... B05B 1/18
9,333,479 B2 * 5/2016 Persson ..... B01J 8/10
2004/0195381 A1 * 10/2004 Luettgen ..... B05B 1/1654 239/463
2005/0144773 A1 * 7/2005 Mathieu ..... A47L 15/23 29/566
2006/0043214 A1 * 3/2006 Macan ..... B05B 3/049 239/222.11
2006/0144968 A1 * 7/2006 Lev ..... B05B 3/0427 239/590
2010/0127096 A1 * 5/2010 Leber ..... B05B 3/04 239/101
2012/0104118 A1 * 5/2012 Wang ..... B05B 3/044 239/380
2012/0175431 A1 * 7/2012 Althammer ..... B05B 1/20 239/263
2013/0180555 A1 * 7/2013 Lee ..... B05B 3/06 134/181
2015/0007770 A1 * 1/2015 Chandrasekharan ..... C23C 16/45572 118/715

(Continued)

*Primary Examiner* — Joseph A Greenlund
(74) *Attorney, Agent, or Firm* — Kriegsman & Kriegsman

(57) ABSTRACT

A shower head includes a spinning disk, which includes a fluid inlet, an upper plate coupled to the fluid inlet at the center of the upper plate, a lower plate coupled to the upper plate to form a perimeter edge of the spinning disk, at least two side spin ports on the perimeter edge, each side spin port is configured to project the fluid at a fluid projection angle relative to the perimeter edge and not perpendicular to the perimeter edge at such side spin port, and a plurality of fluid outlets on the lower plate configured to allow the fluid to flow out of the spinning disk, wherein the spinning disk is configured to spin when the fluid is projected from the at least two side pin ports while the fluid also flows out of the spinning disk from the fluid outlets.

19 Claims, 4 Drawing Sheets

(56) References Cited

U.S. PATENT DOCUMENTS

| | | | | |
|---|---|---|---|---|
| 2016/0121344 | A1* | 5/2016 | Chan | B05B 1/185<br>239/117 |
| 2017/0087565 | A1* | 3/2017 | Hou | B05B 15/654 |
| 2017/0150866 | A1* | 6/2017 | Feddema | A47L 15/23 |
| 2019/0351436 | A1* | 11/2019 | Kajuch | B05B 3/0427 |
| 2020/0086336 | A1* | 3/2020 | Rosko | B05B 3/0427 |
| 2020/0246811 | A1* | 8/2020 | Medeiros | E03C 1/0408 |

* cited by examiner

SHOWER HEAD

FIELD OF THE INVENTION

The disclosed subject matter herein relates generally to fluid discharging devices, such as a shower head, and, more particularly, to a shower head that can discharge water in a spinning pattern.

BACKGROUND

Existing shower heads are usually fixed and do not rotate automatically while in use. The water discharged from the shower head is usually in a fixed pattern. In some existing shower heads, although the water discharging pattern may be adjustable, it usually requires a manual adjustment mechanism, such as twisting the shower head by hand.

SUMMARY

The disclosed subject matter herein describes a shower head that can discharge water in a spinning pattern.

In one aspect, the disclosed subject matter discloses a shower head, which includes a spinning disk, which includes a fluid inlet, an upper plate with a first perimeter, coupled to the fluid inlet at the center of the upper plate, allowing fluid to flow into the spinning disk from the fluid inlet, a lower plate with a second perimeter, coupled to the upper plate at the first and second perimeters to form a perimeter edge of the spinning disk, three or four side spin ports spaced substantially evenly from each other on the perimeter edge, each side spin port is configured to project the fluid at a fluid projection angle relative to the perimeter edge and not perpendicular to the perimeter edge at such side spin port, and a plurality of fluid outlets on the lower plate configured to allow the fluid to flow out of the spinning disk, wherein the spinning disk is configured to spin when the fluid is projected from the three or four side pin ports while the fluid also flows out of the spinning disk from the fluid outlets, and wherein the plurality of fluid outlets on the lower plate are aligned to form three or four curved lines, each of the three or four curved lines originates at or near the center of the lower plate and ends at one of the three or four side spin ports on the perimeter edge, a coupling, rotatably coupled with the spinning disk, allowing the spinning disk to rotate against the coupling, and a housing, coupled with the coupling at the center of the housing and configured to block the fluid projected from the three or four side spin ports on the perimeter edge of the spinning disk.

In some embodiments, the shower head further includes at least one washer, positioned on top of the coupling to prevent leak, a spinning disk lock ring, positioned around the fluid inlet of the spinning disk and on top of the at least one washer to prevent leak and allow rotation of the spinning disk, a connection elbow, coupled to the coupling to allow the fluid to flow into the shower head, and a housing lock ring, coupled with the housing to prevent leak.

In another aspect, the disclosed subject matter discloses a spinning disk, which includes a fluid inlet, an upper plate with a first perimeter, coupled to the fluid inlet at the center of the upper plate, allowing fluid to flow into the spinning disk from the fluid inlet, a lower plate with a second perimeter, coupled to the upper plate at the first and second perimeters to form a perimeter edge of the spinning disk, at least two side spin ports on the perimeter edge, each side spin port is configured to project the fluid at a fluid projection angle relative to the perimeter edge and not perpendicular to the perimeter edge at such side spin port, and a plurality of fluid outlets on the lower plate configured to allow the fluid to flow out of the spinning disk, wherein the spinning disk is configured to spin when the fluid is projected from the at least two side pin ports while the fluid also flows out of the spinning disk from the fluid outlets.

In some embodiments, the at least two side spin ports are spaced substantially evenly from each other on the perimeter edge and wherein the fluid projection angles of the at least two side spin ports relative to the perimeter edge are substantially the same.

In some embodiments, the at least two side spin ports are configured to project the fluid at opposite directions.

In some embodiments, there are three side spin ports spaced substantially evenly from each other on the perimeter edge and wherein the fluid projection angles of the three side spin ports relative to the perimeter edge are substantially the same.

In some embodiments, there are four side spin ports spaced substantially evenly from each other on the perimeter edge and wherein the fluid projection angles of the three side spin ports relative to the perimeter edge are substantially the same.

In some embodiments, the first perimeter of the upper plate and the second perimeter of the lower plate are substantially round and the perimeter edge of the spinning disk is substantially round.

In some embodiments, the first perimeter of the upper plate and the second perimeter of the lower plate are substantially square and the perimeter edge of the spinning disk is substantially square.

In some embodiments, there are four side spin ports on the perimeter edge, each of the four side spin ports is positioned at each corner of the perimeter edge.

In some embodiments, there are four side spin ports on the perimeter edge, each of the four side spin ports is positioned at the middle of each side of the perimeter edge.

In some embodiments, each side spin port is adjustable.

In some embodiments, the plurality of fluid outlets on the lower plate are aligned to form at least two lines, each of the at least two lines originates at or near the center of the lower plate and ends at one of the at least two side spin ports on the perimeter edge.

In some embodiments, each of the at least two lines is curved.

In some embodiments, each of the at least two lines is formed along one of multiple channels on the inner surface of the lower plate.

In some embodiments, each of the multiple channels is concave on the inner surface of the lower plate.

In some embodiments, the plurality of fluid outlets are positioned at the bottom of the concave multiple channels on the inner surfaced of the lower plate.

In yet another aspect, the disclosed subject matter discloses a shower head, which includes a spinning disk, which includes a fluid inlet, an upper plate with a first perimeter, coupled to the fluid inlet at the center of the upper plate, allowing fluid to flow into the spinning disk from the fluid inlet, a lower plate with a second perimeter, coupled to the upper plate at the first and second perimeters to form a perimeter edge of the spinning disk, at least two side spin ports on the perimeter edge, each side spin port is configured to project the fluid at a fluid projection angle relative to the perimeter edge and not perpendicular to the perimeter edge at such side spin port, and a plurality of fluid outlets on the lower plate configured to allow the fluid to flow out of the spinning disk, wherein the spinning disk is configured to spin when the fluid is projected from the at least two side pin ports while the fluid also flows out of the spinning disk from the fluid outlets, a coupling, rotatably coupled with the spinning disk, allowing the spinning disk to rotate against the coupling, and a housing, coupled with the coupling at the center of the housing and configured to block the fluid projected from the at least two side spin ports on the perimeter edge of the spinning disk.

In some embodiments, the shower head further includes at least one washer, positioned on top of the coupling to prevent leak, a spinning disk lock ring, positioned around the fluid inlet of the spinning disk and on top of the at least one washer to prevent leak and allow rotation of the spinning disk, a connection elbow, coupled to the coupling to allow the fluid to flow into the shower head, and a housing lock ring, coupled with the housing to prevent leak.

In some embodiments, two washers are positioned on top of the coupling to prevent leak.

It is to be understood that both the foregoing general description, and the following detailed description, are exemplary and explanatory only and are intended to provide a further explanation of the disclosed subject matter herein, as claimed.

DETAILED DESCRIPTION

The disclosed subject matter herein describe a shower head that can discharge water in a spinning pattern.

Figure 1:
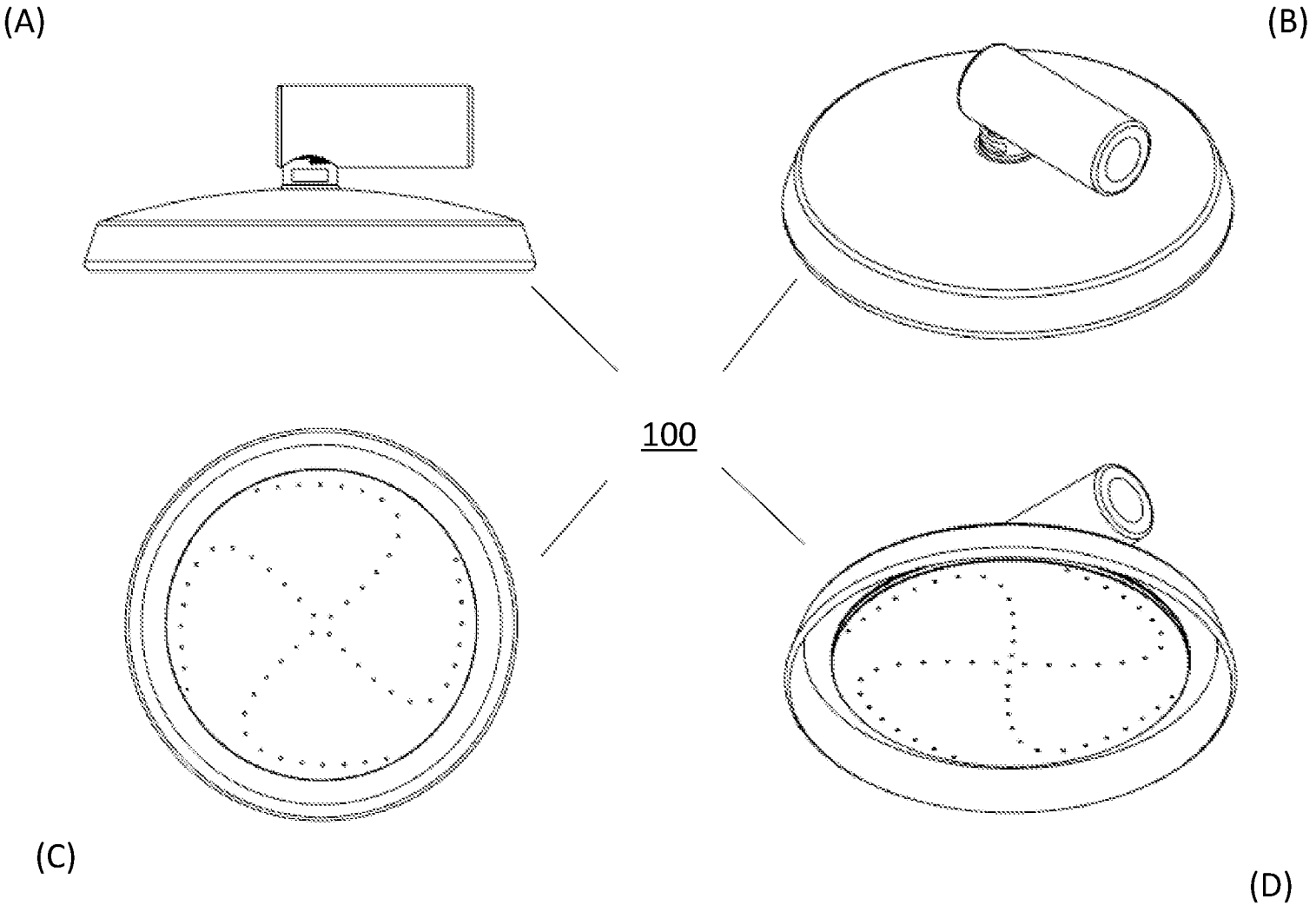
FIG. 1 contains four views of a shower head according to certain embodiments of the disclosed subject matter herein.

FIG. 1 contains four views of a shower head 100 according to certain embodiments of the disclosed subject matter herein. FIG. 1(A) shows a side view of the shower head 100. FIG. 1(B) shows an isometric top view of the shower head 100. FIG. 1(C) shows a bottom view of the shower head 100. FIG. 1(D) shows an isometric bottom view of the shower head 100.

Figure 2:
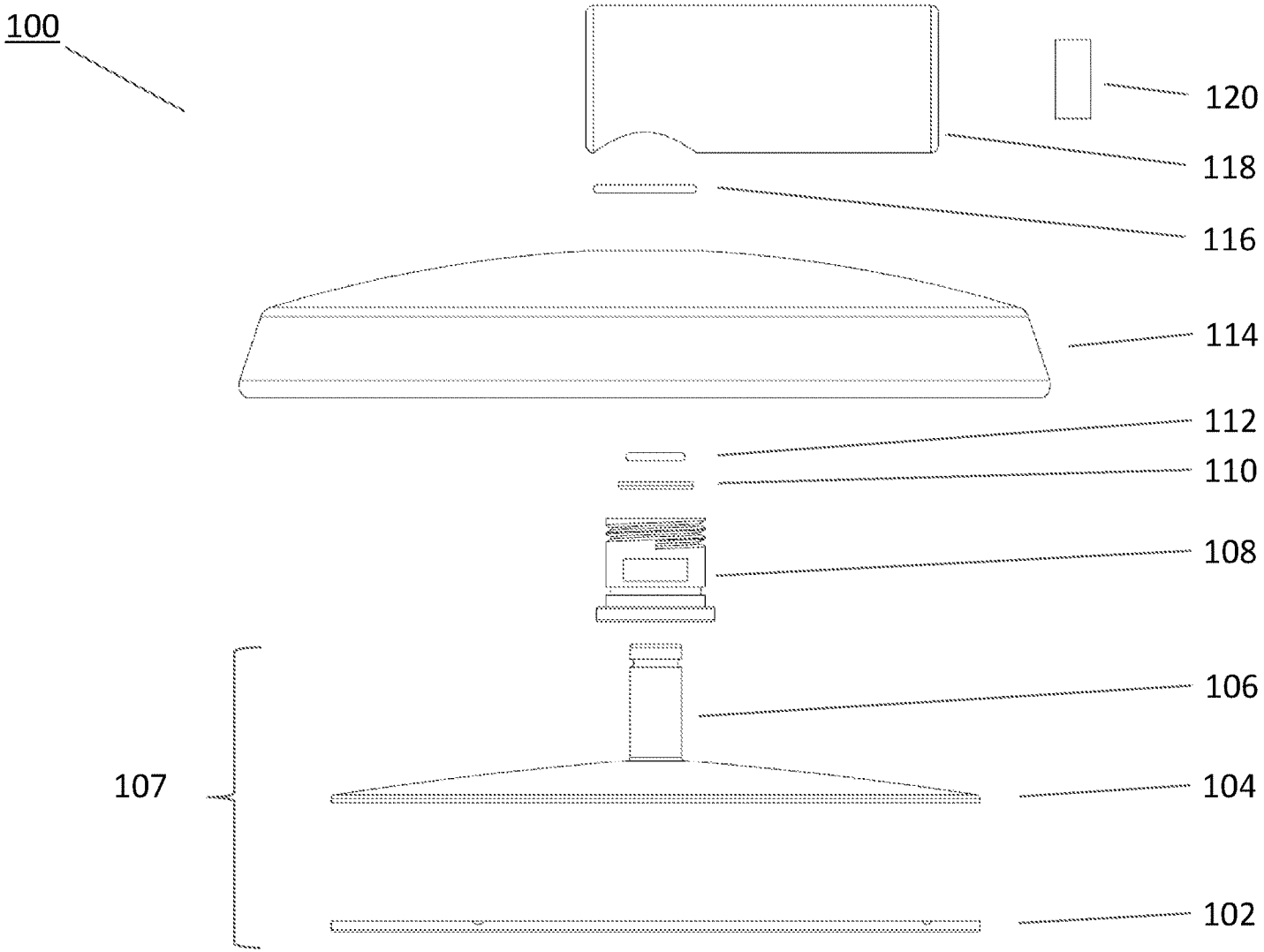
FIG. 2 shows an exploded view of the shower head depicted in FIG. 1.

FIG. 2 shows an exploded view of the shower head 100 depicted in FIG. 1. The shower head 100 includes a lower plate 102, an upper plate 104, a fluid inlet 106, a coupling 108, at least one washer 110, a spinning disk lock ring 112, a housing 114, a housing lock ring 116, a connection elbow 118, and a flow restrictor 120.

The upper plate 104 has a first perimeter. The lower plate 102 has a second perimeter. The lower plate 102 and the upper plate 104 are coupled together at the first and second perimeters, and along the fluid inlet 106, to form a spinning disk 107. The upper plate 104 is coupled to the fluid inlet 106 at the center of the upper plate 104 to allow fluid to flow into the spinning disk 107.

The coupling 108 is rotatably coupled with the spinning disk 107 to allow the spinning disk 107 to rotate against the coupling 108. The housing 114 is coupled with the coupling 108 at the center of the housing 114 and is configured to block the fluid projecting from the perimeter edge of the spinning disk. The at least one washer 110 is positioned on top of the coupling 108 to prevent water leak. In some embodiments, there are two washers positioned on top of the coupling 108. The spinning disk lock ring 112 is positioned around the fluid inlet 106 and on top of the at least one washer 110 to prevent water leak and allow the spinning disk 107 to rotate in operation. The housing lock ring 116 is coupled to the housing 114 to prevent water leak. The connection elbow 118 is coupled to the coupling 108 to allow the fluid to flow into the shower head 100. The flow restrictor 120 is positioned inside the connection elbow 118 and is configured to restrict the flow of the fluid into the shower head. In some states and regions, plumbing code requires a flow restriction device, such as the flow restrictor 120.

Figure 3:
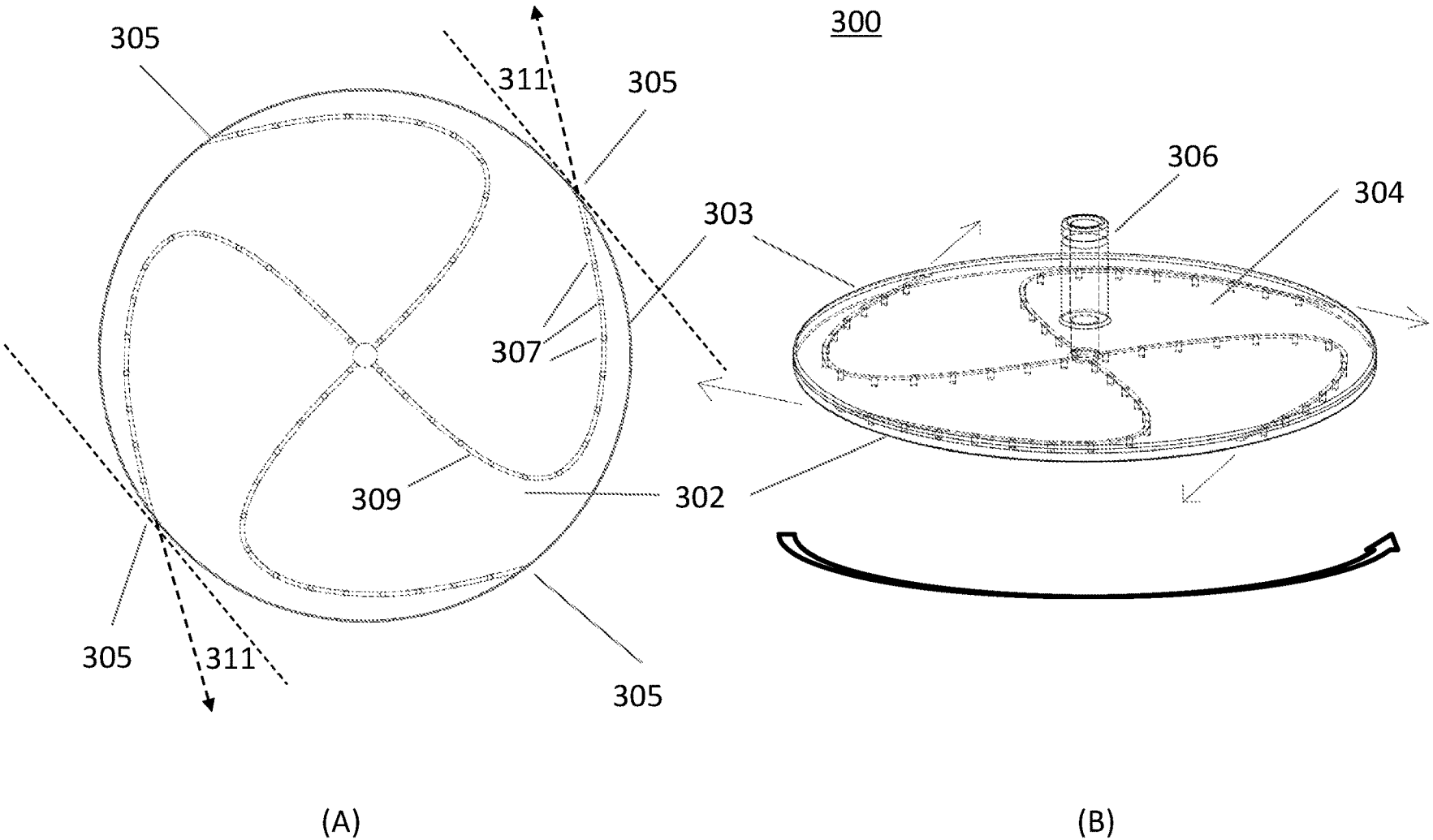
FIG. 3 contains two views of a spinning disk in a shower head according to certain embodiments of the disclosed subject matter herein.

FIG. 3 contains two views of a spinning disk 300 in a shower head according to certain embodiments of the disclosed subject matter herein. FIG. 3(A) is a bottom view of the spinning disk 300. FIG. 3(B) is an isometric view of the spinning disk 300.

The spinning disk 300 includes a lower plate 302, an upper plate 304, a fluid inlet 306, a perimeter edge 303, multiple side spin ports 305 on the perimeter edge 303, and multiple fluid outlets 307 aligned to form multiple lines 309 on the lower plate 302.

The lower plate 302 and the upper plate 304 are coupled together to form the perimeter edge 303 of the spinning disk 300. The lower plate 302 and the upper plate 304 can be bound together in a variety of mechanisms, such as via adhesive (e.g., epoxy) or welding (e.g., ultrasound welding). There are multiple side spin ports 305 on the perimeter edge 303. Each side spin port 305 is configured to project the fluid out of the perimeter edge 303. The fluid is projected at an angle 311 not perpendicular to the perimeter edge. The multiple fluid outlets 307 on the lower plate 302 allow the fluid to flow out of the spinning disk 300. When a shower head containing the spinning disk 300 is in operation, the fluid projects from the perimeter edge 303 of the spinning disk 300 at the angle 311, making the spinning disk 300 spin in one direction. Referring back to FIGS. 1 and 2, the housing 114 is configured to block the fluid projecting from the perimeter edge 303 of the spinning disk 300.

In some embodiments, the multiple side spin ports 305 are spaced substantially evenly from each other on the perimeter edge 303; and the fluid projection angles 311 of the multiple side spin ports 305 relative to the perimeter edge 303 are substantially the same. In some embodiments, the fluid is projected from two side spin ports 305 opposite from each other at the perimeter edge 303 at the opposite directions.

In some embodiments, there are three side spin ports 305 spaced substantially evenly from each other on the perimeter edge 303. The fluid projection angles 311 of the three side spin ports 305 relative to the perimeter edge 303 are substantially the same.

In some embodiments, there are four side spin ports 305 spaced substantially evenly from each other on the perimeter edge 303. The fluid projection angles 311 of the four side spin ports 305 relative to the perimeter edge 303 are substantially the same.

In some embodiments, the first perimeter of the upper plate 304 and the second perimeter of the lower plate 302 are substantially round; and the perimeter edge 303 of the spinning disk 300 is also substantially round. In some embodiments, the first perimeter of the upper plate 304 and the second perimeter of the lower plate 302 are substantially square; and the perimeter edge 303 of the spinning disk 300 is also substantially square. In some embodiments where there is a square-shaped spinning disk, there are four side spin ports 305 on the perimeter edge 303, with either side spin port 305 positioned at each corner of the perimeter edge 303 or on each side (e.g., in the middle of the each side) of the perimeter edge 303.

In some embodiments, each side spin port 305 is adjustable or configurable. For example, each side spin port can be turned open or closed; the size of each side spin port 305 can be adjustable; and the fluid projection angle 311 of each side spin port 305 can be adjustable. The configurability of the side spin ports 305 allows the speed of spinning in operation to be adjustable.

In some embodiments, the multiple fluid outlets 307 are aligned to form at least two lines 309 on the lower plate 302. Each of the lines 309 originates at or near the center of the lower plate 302 and ends at one of the multiple side spin ports 305 on the perimeter edge 303. In some embodiments, the lines 309 are curved. The curved lines can allow longer lines and more fluid outlets 307 on the lower plate 302.

In some embodiments, each of the lines 309 is formed along one of multiple channels on the inner surface of the lower plate 302. Each of the multiple channels can be concave on the inner surface of the lower plate 302. The multiple fluid outlets 307 can be positioned at the bottom of the concave multiple channels on the inner surface of the lower plate 302.

Figure 4:
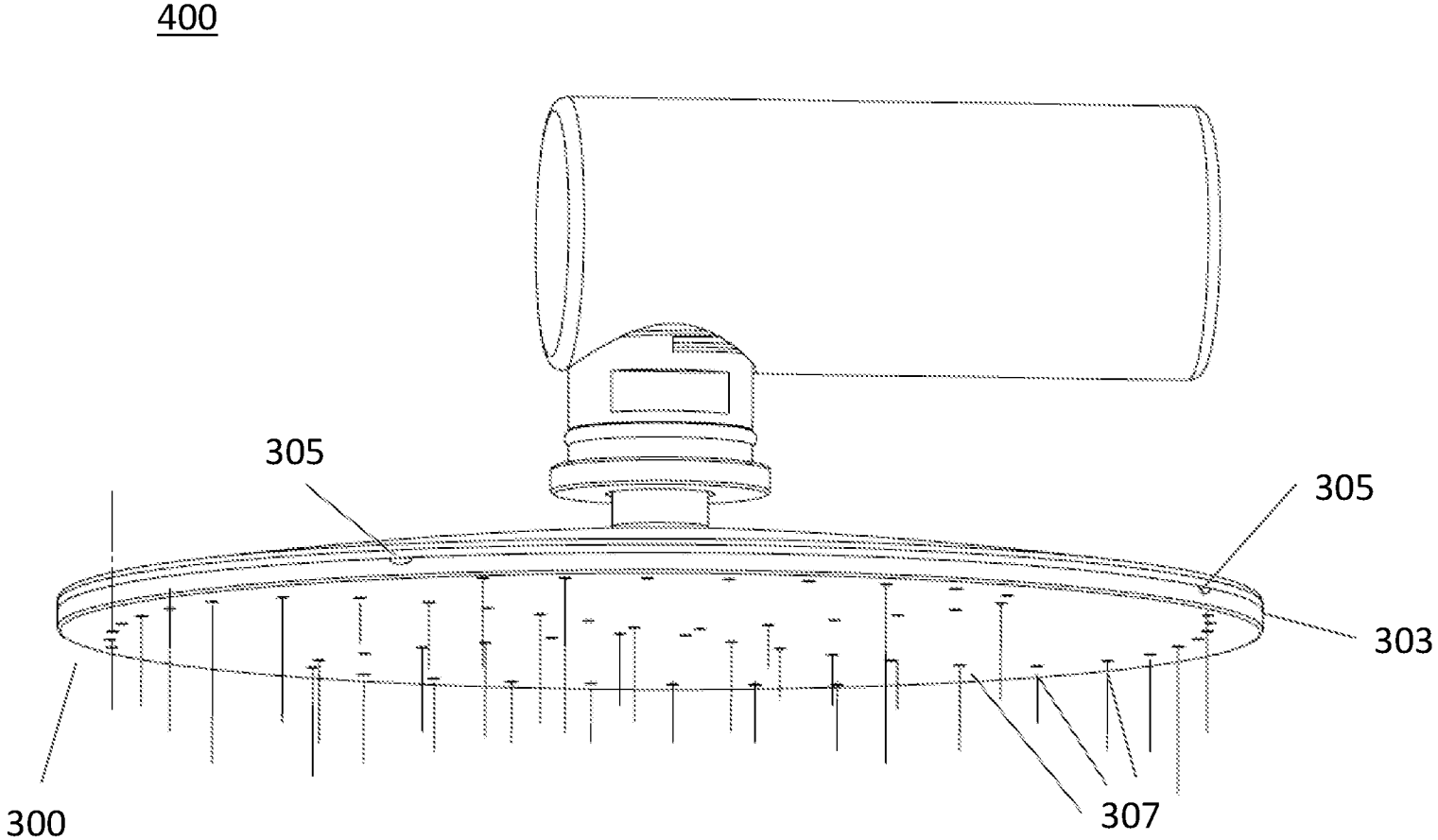
FIG. 4. illustrates the spinning disk depicted in FIG. 3 in operation, according to certain embodiments of the disclosed subject matter herein.

FIG. 4 illustrates the spinning disk 300 depicted in FIG. 3 in operation, according to certain embodiments of the disclosed subject matter herein. In the shower head 400, water flows out of the spinning disk 300 from the multiple fluid outlets 307 while projecting from the side spin ports 305 on the perimeter edge 303 at an angle. The projection of water at an angle causes the spinning disk 300 to spin.

Other embodiments of the disclosed subject matter herein will be apparent to those skilled in the art from consideration of the present specification and practice of the disclosed subject matter disclosed herein. It is intended that the present specification and examples be considered as exemplary only with a true scope and spirit of the disclosed subject matter herein being indicated by the following claims and equivalents thereof.

I claim:

1. A shower head, comprising:

a spinning disk, comprising:

a fluid inlet;

an upper plate with a first perimeter, coupled to the fluid inlet at the center of the upper plate, allowing fluid to flow into the spinning disk from the fluid inlet;

a lower plate with a second perimeter, coupled to the upper plate at the first perimeter to form a perimeter edge of the spinning disk;

three or four side spin ports spaced substantially evenly from each other on the perimeter edge, each side spin port is configured to project the fluid at a fluid projection angle relative to the perimeter edge and not perpendicular to the perimeter edge at each side spin port; and a plurality of fluid outlets on the lower plate configured to allow the fluid to flow out of the spinning disk, wherein the spinning disk is configured to spin when the fluid is projected from the three or four side pin ports while the fluid also flows out of the spinning disk from the fluid outlets, and wherein the plurality of fluid outlets on the lower plate are aligned to form three or four curved lines, each of the three or four curved lines originates at or near the center of the lower plate and ends at one of the three or four side spin ports on the perimeter edge;

a coupling, rotatably coupled with the spinning disk, allowing the spinning disk to rotate against the coupling; and a housing, coupled with the coupling at the center of the housing and configured to block the fluid projected from the three or four side spin ports on the perimeter edge of the spinning disk.

2. The shower head of claim 1, further comprising:

at least one washer, positioned on top of the coupling to prevent leak;

a spinning disk lock ring, positioned around the fluid inlet of the spinning disk and on top of the at least one washer to prevent leak and allow rotation of the spinning disk;

a connection elbow, coupled to the coupling to allow the fluid to flow into the shower head; and a housing lock ring, coupled with the housing to prevent leak.

3. A spinning disk, comprising:

a fluid inlet;

an upper plate with a first perimeter, coupled to the fluid inlet at the center of the upper plate, allowing fluid to flow into the spinning disk from the fluid inlet;

a lower plate with a second perimeter, coupled to the upper plate at the first perimeter to form a perimeter edge of the spinning disk;

at least two side spin ports on the perimeter edge, each side spin port is configured to project the fluid at a fluid projection angle relative to the perimeter edge and not perpendicular to the perimeter edge at each side spin port; and a plurality of fluid outlets on the lower plate configured to allow the fluid to flow out of the spinning disk, wherein the plurality of fluid outlets on the lower plate are aligned to form at least two lines, each of the at least two lines originates at or near the center of the lower plate and ends at one of the at least two spin ports on the perimeter edge, wherein the spinning disk is configured to spin when the fluid is projected from the at least two side pin ports while the fluid also flows out of the spinning disk from the fluid outlets.

4. The spinning disk of claim 3, wherein the at least two side spin ports are spaced substantially evenly from each other on the perimeter edge and wherein the fluid projection angles of the at least two side spin ports relative to the perimeter edge are substantially the same.

5. The spinning disk of claim 4, wherein the at least two side spin ports are configured to project the fluid at opposite directions.

6. The spinning disk of claim 3, wherein there are three side spin ports spaced substantially evenly from each other on the perimeter edge and wherein the fluid projection angles of the three side spin ports relative to the perimeter edge are substantially the same.

7. The spinning disk of claim 3, wherein there are four side spin ports spaced substantially evenly from each other on the perimeter edge and wherein the fluid projection angles of the three side spin ports relative to the perimeter edge are substantially the same.

8. The spinning disk of claim 3, wherein the first perimeter of the upper plate and the second perimeter of the lower plate are substantially round and the perimeter edge of the spinning disk is substantially round.

9. The spinning disk of claim 3, wherein the first perimeter of the upper plate and the second perimeter of the lower plate are substantially square and the perimeter edge of the spinning disk is substantially square.

10. The spinning disk of claim 9, wherein there are four side spin ports on the perimeter edge, each of the four side spin ports is positioned at each corner of the perimeter edge.

11. The spinning disk of claim 9, wherein there are four side spin ports on the perimeter edge, each of the four side spin ports is positioned at the middle of each side of the perimeter edge.

12. The spinning disk of claim 3, wherein each side spin port is adjustable.

13. The spinning disk of claim 3, wherein each of the at least two lines is curved.

14. The spinning disk of claim 3, wherein each of the at least two lines is formed along one of multiple channels on the inner surface of the lower plate.

15. The spinning disk of claim 14, wherein each of the multiple channels is concave on the inner surface of the lower plate.

16. The spinning disk of claim 15, wherein the plurality of fluid outlets are positioned at the bottom of the concave multiple channels on the inner surfaced of the lower plate.

17. A shower head, comprising:

a spinning disk, comprising: a fluid inlet;

an upper plate with a first perimeter, coupled to the fluid inlet at the center of the upper plate, allowing fluid to flow into the spinning disk from the fluid inlet;

a lower plate with a second perimeter, coupled to the upper plate at the first perimeter to form a perimeter edge of the spinning disk;

at least two side spin ports on the perimeter edge, each side spin port is configured to project the fluid at a fluid projection angle relative to the perimeter edge and not perpendicular to the perimeter edge at each side spin port; and a plurality of fluid outlets on the lower plate configured to allow the fluid to flow out of the spinning disk, wherein the spinning disk is configured to spin when the fluid is projected from the at least two side pin ports while the fluid also flows out of the spinning disk from the fluid outlets, wherein the plurality of fluid outlets on the lower plate are aligned to form at least two lines, each of the at least two lines originates at or near the center of the lower plate and ends at one et the at least two side spin ports on the perimeter edge;

a coupling, rotatably coupled with the spinning disk, allowing the spinning disk to rotate against the coupling; and a housing, coupled with the coupling at the center of the housing and configured to block the fluid projected from the at least two side spin ports on the perimeter edge of the spinning disk.

18. The shower head of claim 16, further comprising:

at least one washer, positioned on top of the coupling to prevent leak;

a spinning disk lock ring, positioned around the fluid inlet of the spinning disk and on top of the at least one washer to prevent leak and allow rotation of the spinning disk;

a connection elbow, coupled to the coupling to allow the fluid to flow into the shower head; and a housing lock ring, coupled with the housing to prevent leak.

19. The shower head of claim 18, wherein two washers are positioned on top of the coupling to prevent leak.

* * * * *